US005926963A

United States Patent [19]

Knight

[11] Patent Number: 5,926,963

[45] Date of Patent: Jul. 27, 1999

[54] FIBER OPTIC FORWARD SIGHT FOR RIFLE BARRELS

[75] Inventor: William A. Knight, Centerville, Iowa

[73] Assignee: Modern Muzzleloading, Inc., Centerville, Iowa

[21] Appl. No.: 08/751,997

[22] Filed: Nov. 15, 1996

[51] Int. Cl.[6] ..... F41G 1/42; F41G 1/01

[52] U.S. Cl. ..... 33/241; 42/100

[58] Field of Search ..... 42/100, 101; 33/241, 33/265; 350/569

[56] References Cited

U.S. PATENT DOCUMENTS

| | | | |
|---|---|---|---|
| Re. 24,313 | 5/1957 | Munsey | 33/47 |
| 3,914,873 | 10/1975 | Elliott, Jr. et al. | 42/100 |
| 3,945,142 | 3/1976 | Keppeler | 42/100 |
| 4,434,560 | 3/1984 | Comeyne | 33/241 |
| 4,792,673 | 12/1988 | Blackler | 250/213 |
| 4,953,302 | 9/1990 | Gould | 33/265 |
| 5,044,748 | 9/1991 | Scott et al. | 356/251 |
| 5,168,631 | 12/1992 | Sherman | 33/265 |
| 5,181,718 | 1/1993 | Valentine | 273/69 |
| 5,442,861 | 8/1995 | Lorocco | 33/241 |
| 5,493,450 | 2/1996 | Ekstrand | 42/100 |
| 5,638,604 | 6/1997 | Lorocco | 33/241 |
| 5,653,034 | 8/1997 | Bindon | 33/241 |
| 5,724,761 | 3/1998 | Bergacker | 42/100 |

FOREIGN PATENT DOCUMENTS

| | | | |
|---|---|---|---|
| 470016 | 2/1992 | France | 33/241 |
| 4214997A1 | 11/1993 | Germany | 33/241 |

*Primary Examiner*—Charles T. Jordan
*Assistant Examiner*—Denise J. Buckley
*Attorney, Agent, or Firm*—Zarley, McKee, Thomte, Voorhees & Sease

[57] ABSTRACT

A forward sight for a rifle barrel has a sight element having a base portion for engagement with the forward end of the rifle barrel. An elongated fiber optic member is on the base member and has a rearward end exposed to view by sighting longitudinally towards the rearward end of the base portion. The fiber optic member is partially imbedded in the base member and extends through at least one raised portion on the raised member. The base portion is comprised of a transparent one-piece material extending substantially along the length of the fiber optic member to obtain substantial exposure of the fiber optic member to ambient light.

9 Claims, 2 Drawing Sheets

FIBER OPTIC FORWARD SIGHT FOR RIFLE BARRELS

BACKGROUND OF THE INVENTION

The forward sight on a rifle barrel normally comprises a small cylindrical image for alignment with the rear sight and the desired target, so that the projectile discharged from the barrel will be delivered to the target. Depending on exterior lighting conditions, the forward sight is sometimes difficult to see, and is often difficult to see with precision.

Fiber optics have been used for sighting purposes, but they are housed with support systems that prevent exterior light from providing maximum illumination of the fiber optic element.

It is therefore a principal object of this invention to provide a fiber optic sight for the forward end of a rifle barrel that will receive maximum illumination from the surrounding light.

A still further object of the invention is to provide a fiber optic sight for the forward end of a rifle barrel that is fully transparent so that the fiber optic element is fully illuminated from the surrounding light.

These and other objects will be apparent to those skilled in the art.

SUMMARY OF THE INVENTION

A forward sight for a rifle barrel has a sight element having a base portion for engagement with the forward end of the rifle barrel. An elongated fiber optic member is on the base member and has a rearward end exposed to view by sighting longitudinally towards the rearward end of the base portion. The fiber optic member is partially imbedded in the base member and extends through at least one raised portion on the raised member. The base portion is comprised of a transparent one-piece material extending substantially along the length of the fiber optic member to obtain substantial exposure of the fiber optic member to ambient light.

DESCRIPTION OF THE PREFERRED EMBODIMENT

The term "rifle" as used herein shall refer to any rifle, shotgun, or handgun which utilizes an elongated barrel for discharge of the projectile of the weapon.

Figure 1:
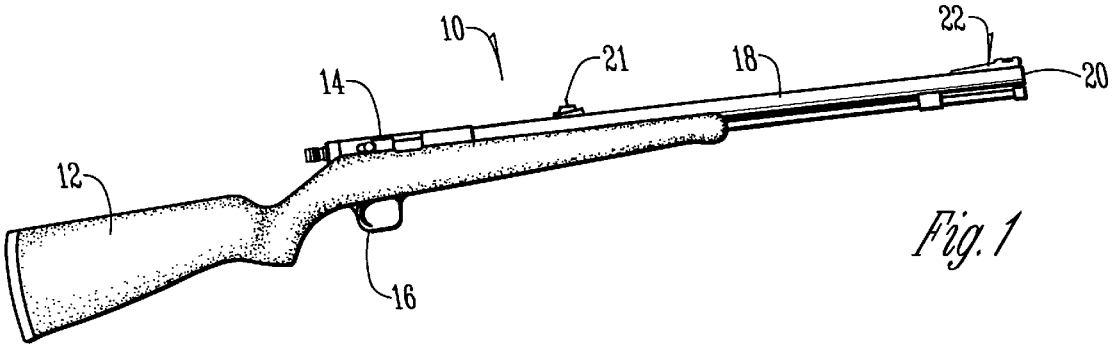
FIG. 1 is a side elevational view of a rifle with the forward sight of this invention mounted thereon.

With reference to FIG. 1, a modern muzzleloading rifle 10 has a conventional stock 12, a receiver 14, a trigger mechanism 16, and a barrel 18 which has a forward end 20. A conventional rearward sight 21 is mounted on the rearward portion of barrel 18.

Figure 2:
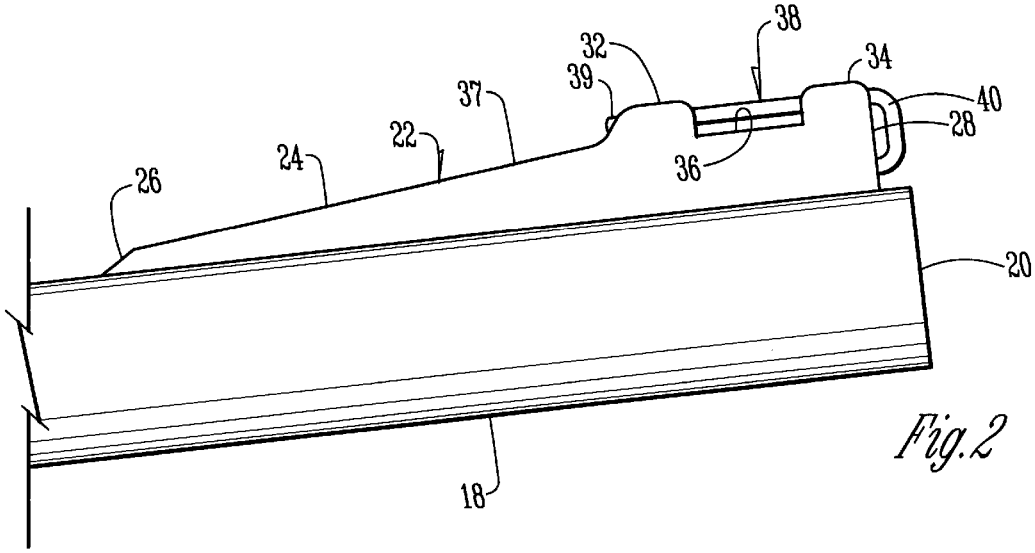
FIG. 2 is an enlarged scale elevational view of the forward end of the rifle as shown in FIG. 1.
Figure 3:
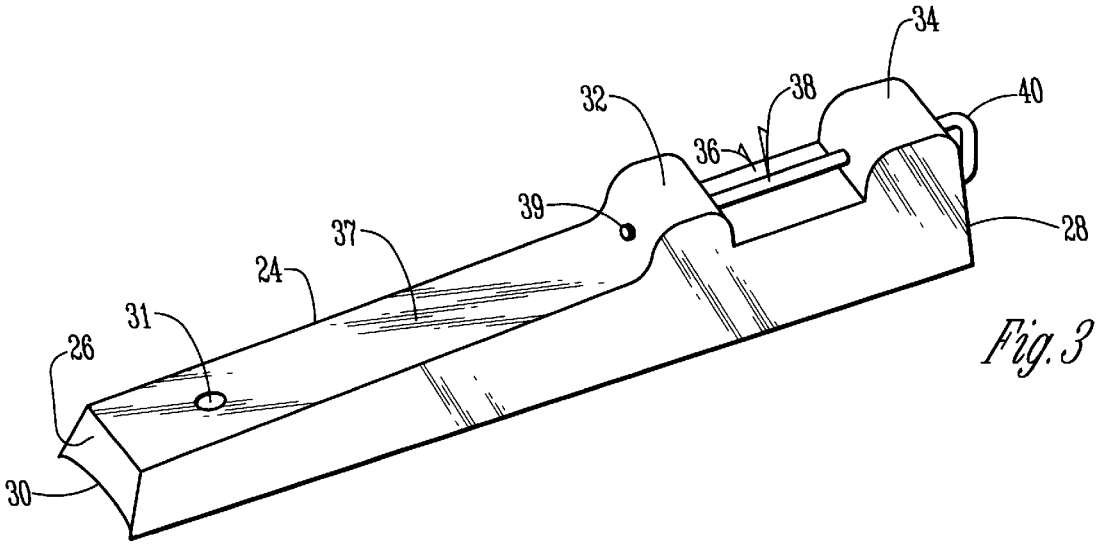
FIG. 3 is a large scale perspective view of the forward sight element of FIGS. 1 and 2.

The forward sight element 22 of this invention is best shown in FIGS. 2 and 3. The sight element 22 has an elongated base portion 24 which has a longitudinal axis in the same plane as the central axis of the barrel 18. Base portion 24 has a rearward end 26 and a forward end 28. The bottom portion 30 of the base portion 24 is curved to permit it to fit tightly on the curved outer surface of barrel 18. An aperture 31 or the like is located within base portion 24 to receive a set screw or the like for attachment of the sight element 22 to the barrel.

The base portion 24 extends in an upwardly sloping direction from the rear end 26 wherein a pair of spaced raised portions 32 and 34 are created and are separated by an open notch 36. The tapered surface 37 of the base portion permits the rearward elevation of the raised portion 32 to be fully seen when viewed from a rearward direction.

A conventional elongated fiber optic member 38 extends through the raised portions 32 and 34 and extends in a direction substantially parallel to the bottom of notch 36. This is accomplished by suitable apertures located in each of the raised portions. The rearward end 39 of the fiber optic member 38 is exposed to view in the rearward surface of the raised portion 32. As shown in FIGS. 2 and 3, the forward end 40 of the fiber optic member 38 is bent downwardly and thence rearwardly to be imbedded within the forward end 28 of the base member.

Figure 4:
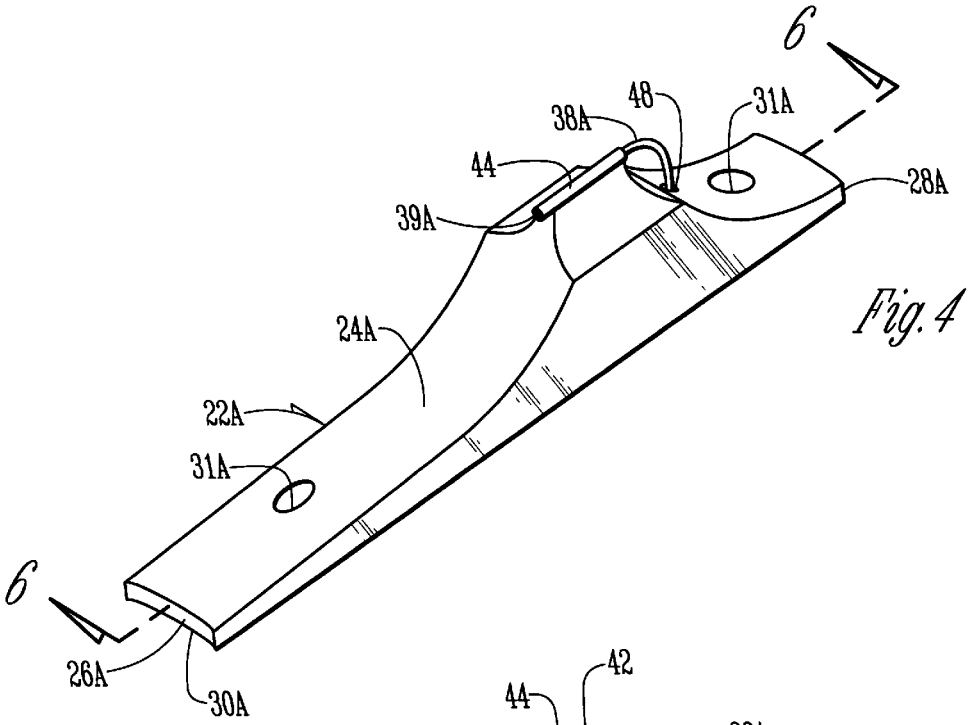
FIG. 4 is a large scale perspective view of an alternate form of the invention.
Figure 5:
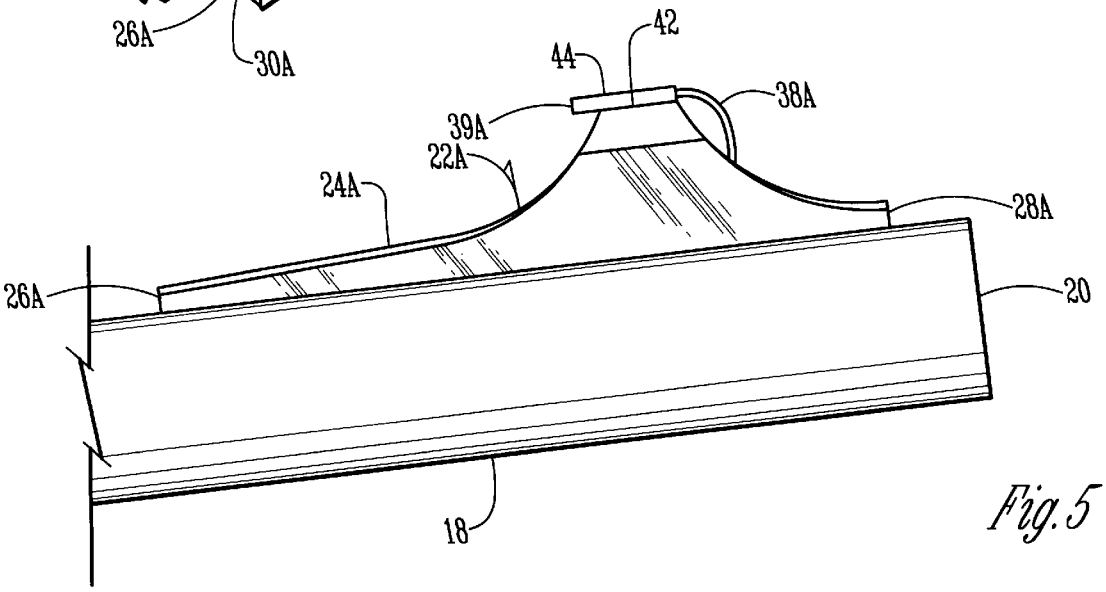
FIG. 5 is a large scale elevational view thereof similar to FIG. 2.
Figure 6:
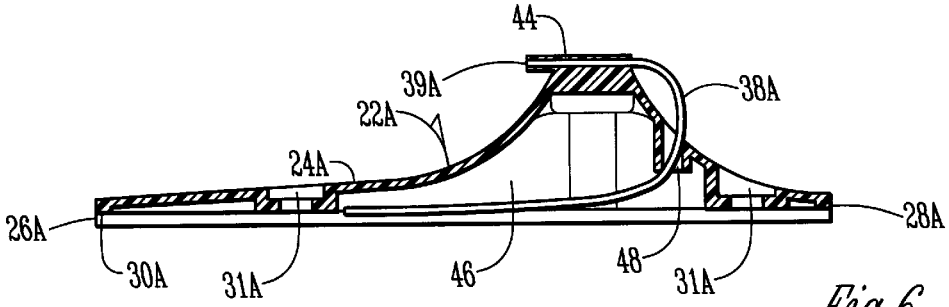
FIG. 6 is a longitudinal sectional view of the device taken on line 6—6 of FIG. 4.

With reference to the alternate embodiment of the invention shown in FIGS. 4–6, the sight element 22 has an elongated base portion 24A which has a longitudinal axis in the same plane as the central axis of barrel 18. Base portion 24A has rearward end 26A and forward end 28A. The bottom portion 30A of the base portion 24A is curved to permit it to fit tightly on the curved outer surface of barrel 18. Apertures 31A are located within base portion 24A to receive a set screw or the like for attachment of the sight element 22A to the barrel.

The base portion 24A extends in an upper sloping direction from rear end 26A and terminates in an axially extending horizontal upstanding center ridge 42. An elongated hollow holding tube 44 is longitudinally formed on top of ridge 42. The base portion 24A has a hollow interior 46 with an access port 48. An elongated fiber optic member 38A with a rearward end 39A extends through tube 44, thence downwardly through port 48, and then is bent to extend forwardly into hollow interior 46.

It is very important to note that the base members 24 and 24A are comprised of a transparent material such as acrylic plastic so that light can pass through the base portion for exposure to the fiber optic members 38 or 38A which conventionally energizes these members so that light is clearly visible through the rearward ends 39 and 39A thereof. Base portions 24 and 24A are also preferably comprised of a single integral piece rather than composite pieces.

It can be seen that when the forward sights 22 or 22A are placed on the forward end 20 of barrel 18, the fiber optic members receive maximum exposure to the ambient or surrounding light, whereupon a maximum amount of light will be exposed to view at these rearward ends 39 and 39A. Thus, by aligning the rearward sight 21 with the rearward ends of the fiber optic members, with both sights being aligned with the target, greater accuracy can be obtained because of the greater visibility of the forward sight elements.

Therefore, it is seen that this invention will achieve at least all of its stated objectives.

What is claimed is:

1. A forward sight for a rifle barrel, comprising, a sight element including a base portion for engagement with the forward end of a rifle barrel, an elongated fiber optic member on said base portion and having a rearward end exposed to view by sighting longitudinally towards the rearward end of said base portion, said base portion being comprised of a transparent material substantially along the length of said fiber optic member to obtain substantial exposure of said fiber optic base member to light surrounding said rifle, said base portion has an axially extending horizontal center ridge with a hollow holding tube longitudinally mounted thereon, with said rearward end of said fiber optic member being positioned in said tube, said fiber optic member extends forwardly from said tube, and thence downwardly into said portion, said base portion is hollow and receives a forward end of said fiber optic member.

2. The combination of claim 1 wherein said base portion is a single piece of transparent plastic material.

3. The combination of claim 1 wherein said fiber optic member is at least partially embedded in said base portion.

4. The combination of claim 1 wherein said base portion has two longitudinally aligned raised portions with an open notch therebetweeen, with said fiber optic member being embedded with said two raised portions and extending across said open notch.

5. The combination of claim 4 wherein said fiber optic member has a forward end portion which extends forwardly through the raised portion nearest the forward end of said barrel, and is thence bent downwardly and rearwardly to terminate in said forwardmost raised portion.

6. The combination of claim 4 wherein a surface portion of said base portion rearwardly of said raised portions is sloped downwardly and rearwardly towards the rearward end of said base portion.

7. The device of claim 1 wherein said base portion has two longitudinally aligned raised portions with an open notch therebetweeen, with said fiber optic member being embedded with said two raised portions and extending across said open notch.

8. The combination of a rifle having an elongated barrel with a forward sight element on the forward end thereof, a sight element secured to the forward end of the rifle barrel, said sight element including a base portion in engagement with said barrel and having forward and rearward ends, means for securing said base portion to said barrel, an elongated fiber optic member on said base portion and having a rearward end exposed to view by sighting in a longitudinal direction along the top of said barrel towards the rearward end of said base portion, said base portion being comprised of a transparent material substantially along the length of said fiber optic member to obtain substantial exposure of said fiber optic member to light surrounding said rifle, said base portion has an axially extending horizontal center ridge with a hollow holding tube longitudinally mounted thereon, with said rearward end of said fiber optic member being positioned in said tube, said fiber optic member extends forwardly from said tube, and thence downwardly into said base portion, said base portion being hollow and receives a forward end of said fiber optic member.

9. The combination of claim 8 wherein said fiber optic member has an end opposite to said rearward end that is in a substantially horizontal position within said base portion.

* * * * *